US005154642A

United States Patent [19]

Chung-Yin

[11] Patent Number: 5,154,642

[45] Date of Patent: Oct. 13, 1992

[54] INNOVATIVE POWER PLUG SOCKET ASSEMBLY

[76] Inventor: Lu Chung-Yin, No. 67, Kuang Hwa 2nd Street, Nan Yar Li, Hsin Chu City, Taiwan

[21] Appl. No.: 620,086

[22] Filed: Nov. 30, 1990

[51] Int. Cl.[5] ..... H01R 13/68

[52] U.S. Cl. ..... 439/622; 439/599; 439/655; 439/695

[58] Field of Search ..... 439/660, 692, 651–655, 439/621, 622, 686, 695, 701, 599, 588, 589, 598, 603

[56] References Cited

U.S. PATENT DOCUMENTS

| | | | |
|---|---|---|---|
| 3,699,500 | 10/1972 | Borzoni et al. | 439/622 |
| 4,592,613 | 6/1986 | Tong | 439/622 |
| 4,684,914 | 8/1987 | Wu | 439/622 |
| 4,738,639 | 4/1988 | Henderson | 439/622 |
| 4,770,647 | 9/1988 | Wu | 439/622 |
| 4,902,250 | 2/1990 | Wu | 439/622 |
| 4,904,976 | 2/1990 | Liaq | 439/622 |
| 5,002,506 | 3/1991 | Tsay | 439/622 |

*Primary Examiner*—David L. Pirlot

[57] ABSTRACT

A power plug socket assembly is provided which includes an outer casing (1) having a bevel block member (10) mounted in a bottom wall of the outer casing (1). An inner block member (2) is insertable and releasably captured by the bevel block member (10) of the outer casing (1). The outer casing (1) includes wall thicknesses at gripping portions which are relatively reduced in thickness with respect to the remaining wall thicknesses of the outer casing (1) in order to resiliently engage with the bottom groove (210) of the inner block member (2) when the inner block member (2) is inserted and pressed or fitted into the outer casing (1) during assembly.

1 Claim, 3 Drawing Sheets

INNOVATIVE POWER PLUG SOCKET ASSEMBLY

BACKGROUND OF THE INVENTION

The present invention relates to a power plug socket assembly which is formed of an outer casing and an inner block insertable within the outer casing. The outer casing defines an internal chamber having a first and second section in open communication each with respect to the other. The subject invention includes the outer casing to have a bottom wall upon which is mounted a bevel block which is insertable and captured within a groove formed on a bottom wall of the inner block member when it is inserted and pressed into the outer casing. Additionally, the outer casing includes a shoulder wall between the first and second sections of the internal chamber with at least a pair of dowel members mounted thereto to provide spacing for passage of lead wires external to the power plug socket assembly when the inner block member is inserted into the outer casing.

DESCRIPTION OF THE PREFERRED EMBODIMENT

Figure 1:
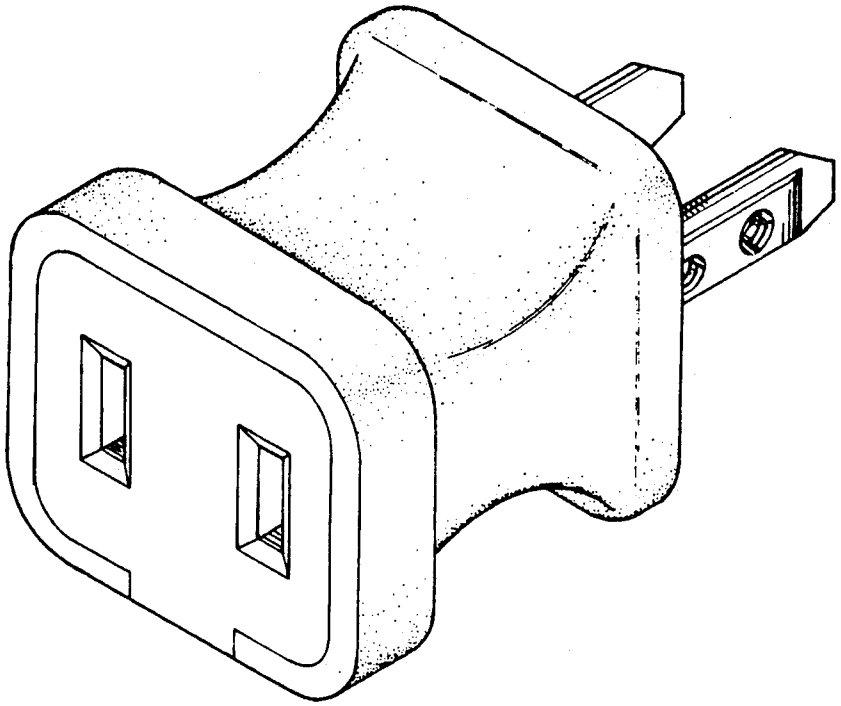
FIG. 1 is a perspective view of the power plug socket assembly embodying the present invention.
Figure 2:
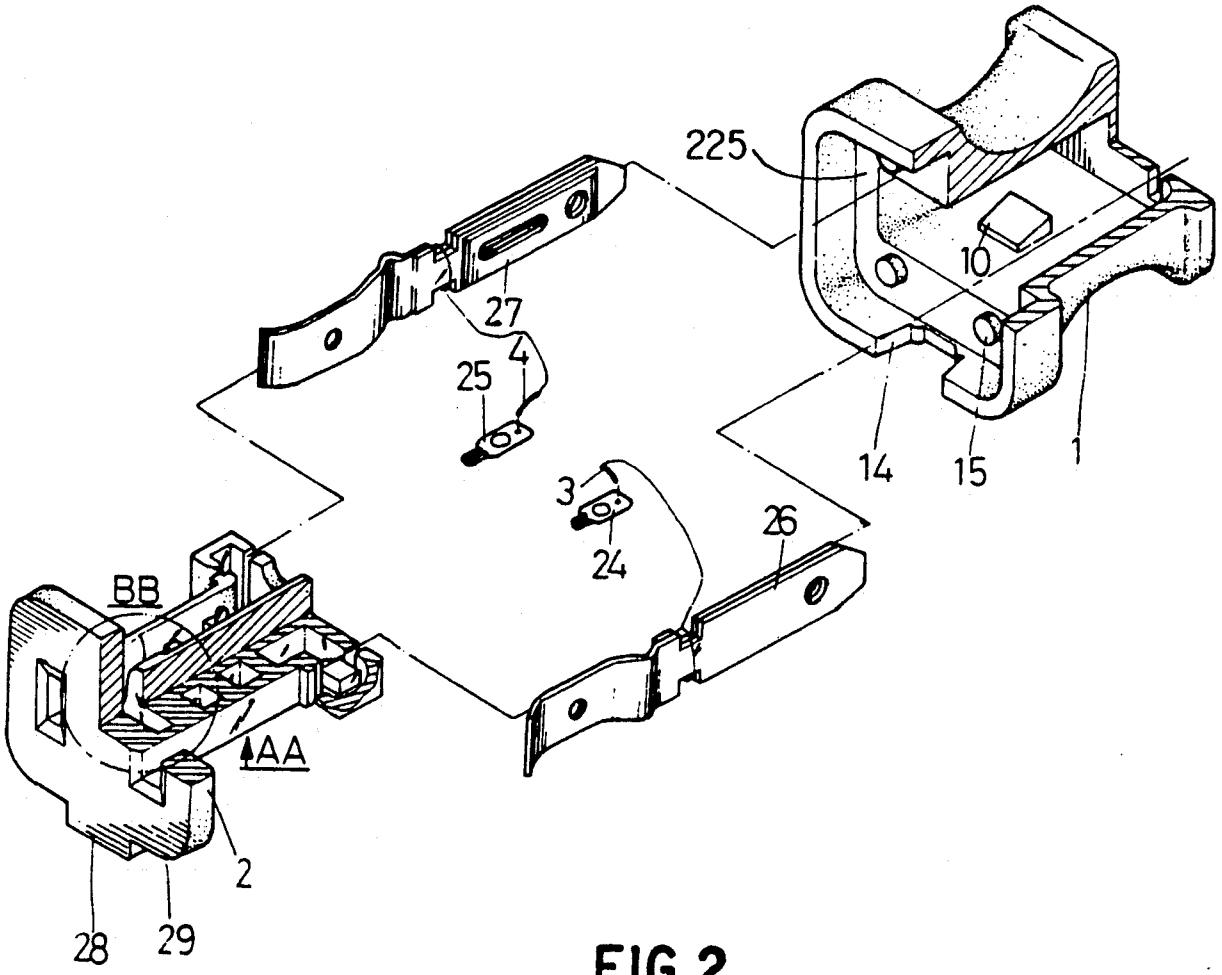
FIG. 2 is a perspective exploded and partially cut-away view of the power plug socket assembly shown in FIG. 1.
Figure 3A:
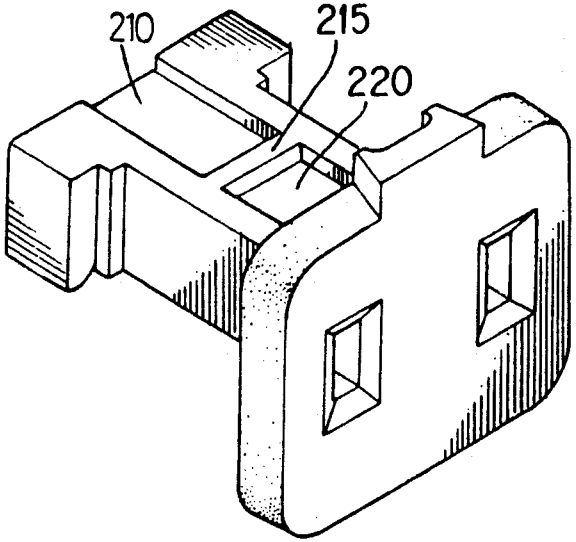
FIG. 3AA is a perspective view of an inner block member showing a bottom groove; and, FIG. 3BB is a perspective view partially cut-away of a power lead holder member.
Figure 3B:
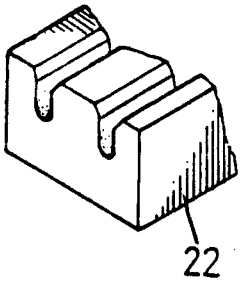

Referring to FIG. 1, there is shown the outer contour of the power plug socket assembly constructed in accordance with the present invention concept. FIG. 2 illustrates the internal structure of the embodiment according to the present invention concept. As shown in FIG. 2, the power plug socket assembly is comprised of outer casing 1 defining an internal chamber having first and second sections as shown by the cut-away view. Inner block member 2 is insertable within the first and second chambers of outer casing 1 and is insertable therein in a longitudinal direction. A pair of copper blades 26 and 27 are provided for insert into both inner block member 2 and outer casing 1 as shown. A pair of fuse wires 3 and 4 of standard construction are provided with a power lead holder 22 shown in FIG. 3BB.

Outer casing 1 includes bevel block member 10 formed on and mounted to a bottom wall surface of the first section of the internal chamber, as is shown in FIG. 2. As shown in FIG. 2, the arcuately directed portions of the wall surface of outer casing 1 provides for wall thicknesses which are relatively reduced with respect to the wall thicknesses of other portions of the outer casing 1 in order to allow for elastic deformation. Inner block member 2 includes bottom groove 210 which is aligned with and longitudinally insertable to bevel block member 10. Bottom groove 10 includes transversely directed ridge member 215 which allows bevel block member 10 to be snappingly inserted within opening 220. In this manner, inner block member 2 is releasably captured within outer casing 1. As is clearly seen, the reduced wall thickness at the gripping areas of casing 1 allows for increased elasticity and deformability when inner block member 2 is inserted and fitted into outer casing 1. Bevel block 10 is resiliently set in groove 210 of inner block member 2 to permit inner block member 2 to be firmly engaged within outer casing 1.

The interface between the first and second section of the internal chamber of outer casing 1 is defined by shoulder wall 225. As can be clearly seen in FIG. 2, the cross-sectional area of the second section of the internal chamber is greater than the cross-sectional area of the first section of the internal chamber. Additionally, rear wall 29 of inner block member 2 has a cross-sectional area substantially equal to the cross-sectional area of the second section of the internal chamber to allow insert of rear wall 29 into the second section of the internal chamber of outer casing 1.

Outer casing 1 additionally contains a plurality of dowels 15 mounted on shoulder wall 225 and extending internal the second section of the internal chamber. When outer casing 1 is engaged with inner block member 2 having a front bottom tenon member 28, such is set in the bottom notch 14 formed in a bottom wall of outer casing 1, as is shown in FIG. 2.

Dowels 15 are used as a stop and spacers for contiguous mounting against rear wall 29 of inner block member 2 to maintain rear wall member 29 of inner block member 2 to be stably positioned and to define a spacing between the rear wall 29 of inner block member 2 and shoulder member 225 of outer casing 1 for the passage through notch 14 of electrical power leads.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

I claim:

1. A power plug socket assembly having electrically coupling members defining electrical blades mounted therein and extending therefrom, said electrical blades being electrically coupled to fuse members, for combined insert into a power source and electrically coupling to an external plug comprising:

an outer casing defining a step configuration internal chamber having a first section and a second section in open communication each with respect to the other, said second section of said internal chamber having a greater cross-sectional area when taken with respect to said first internal chamber section providing a shoulder wall extending around a peripheral boundary of an interface between said first and second chamber, said first internal chamber section having a bottom wall including a bevel block member secured thereto, said shoulder wall including at least a pair of dowel members secured thereto and extending into said second section of said internal chamber in a longitudinal direction, said second section including a second section bottom wall having a notch formed therethrough; and, a longitudinally extending inner block member insertable into said first and second sections of said internal chamber of said outer casing, said inner block member having a rear wall member including a cross-sectional area substantially equal to said cross-sectional area of said second section internal chamber including a tenon having a transverse dimension substantially equal to a transverse dimension of said notch and insertable therein, said inner block member having a bottom wall including a longitudinally extending groove having a transversely extending ridge member for releasably and resiliently capturing said bevel block member, said rear wall of said inner block member contiguously mounted to said dowel members to provide spacing between said rear wall member and said shoulder wall for permitting lead wires to pass through said notch formed through said bottom wall of said outer casing.

* * * * *